US011280463B2

(12) United States Patent
Moser et al.

(10) Patent No.: US 11,280,463 B2
(45) Date of Patent: Mar. 22, 2022

(54) PROJECTION APPARATUS, LIGHTING MODULE AND MOTOR VEHICLE HEADLAMP CONSISTING OF MICRO-OPTICAL SYSTEMS

(71) Applicant: ZKW Group GmbH, Wieselburg (AT)

(72) Inventors: Andreas Moser, Perg (AT); Bernhard Mandl, Ober-Grafendorf (AT); Friedrich Bauer, Bergland (AT)

(73) Assignee: ZKW GROUP GMBH, Wieselburg (AT)

( * ) Notice: Subject to any disclaimer, the term of this patent is extended or adjusted under 35 U.S.C. 154(b) by 0 days.

(21) Appl. No.: 17/265,582

(22) PCT Filed: Aug. 5, 2019

(86) PCT No.: PCT/EP2019/070984
§ 371 (c)(1),
(2) Date: Feb. 3, 2021

(87) PCT Pub. No.: WO2020/030573
PCT Pub. Date: Feb. 13, 2020

(65) Prior Publication Data

US 2021/0341122 A1 Nov. 4, 2021

(30) Foreign Application Priority Data

Aug. 7, 2018 (EP) ..... 18187731

(51) Int. Cl.
*F21S 41/265* (2018.01)
*F21V 5/00* (2018.01)
(Continued)

(52) U.S. Cl.
CPC ..... *F21S 41/265* (2018.01); *F21V 5/004* (2013.01); *F21V 5/08* (2013.01); *F21S 41/143* (2018.01); *F21S 41/43* (2018.01)

(58) Field of Classification Search
CPC ..... F21S 41/265; F21S 41/143; F21S 41/43
See application file for complete search history.

(56) References Cited

U.S. PATENT DOCUMENTS 5,418,583 A * 5/1995 Masumoto ..... G02B 3/0031 348/E9.027
2005/0088853 A1 4/2005 Yatsuda et al.
(Continued)

OTHER PUBLICATIONS

International Search Report for PCT/EP2019/070984, dated Oct. 30, 2019. (2 pages).
(Continued)

*Primary Examiner* — Zheng Song
(74) *Attorney, Agent, or Firm* — Eversheds Sutherland (US) LLP

(57) ABSTRACT

Disclosed is a projection apparatus (2) for a lighting module (1) of a motor vehicle headlamp, the projection apparatus (2) being formed by a plurality of micro-optical systems (3) that are arranged like a matrix; each micro-optical system (3) includes a micro-input optical element (30), a micro-output optical element (31) associated with the micro-input optical element (30), and a micro-diaphragm (32), all micro-input optical elements (31) forming an input optical unit (4), all micro-output optical elements (31) forming an output optical unit (5), and all micro-diaphragms (32) forming a diaphragm device (6); the diaphragm device (6) is disposed in a plane extending substantially perpendicularly to the main direction of emission (Z) of the projection apparatus (2), while the input optical unit (4), the output optical unit (5) and the diaphragm device (6) are disposed in planes extending substantially parallel to one another; the micro-diaphragm (32) of each micro-optical system (3) has an optically effective edge (320, 320*a*, 320*b*, 320*c*, 320*d*, 320*e*), all of the micro-optical systems (3) are subdivided into at least two micro-optical system groups (G1, G2, G3), and the optically
(Continued)

effective edges (320, 320*a*, 320*b*, 320*c*, 320*d*, 320*e*) in the micro-optical systems (3) from different micro-optical system groups (G1, G2, G3) are positioned differently relative to the associated micro-output optical elements (31) within the intermediate image plane.

21 Claims, 5 Drawing Sheets

(51) Int. Cl.

| | |
|---|---|
| ***F21V 5/08*** | (2006.01) |
| *F21S 41/143* | (2018.01) |
| *F21S 41/43* | (2018.01) |

(56) References Cited

U.S. PATENT DOCUMENTS

| | | | | |
|---|---|---|---|---|
| 2014/0146290 | A1 | 5/2014 | Sieler et al. | |
| 2016/0010811 | A1 | 1/2016 | Benitez et al. | |
| 2016/0018081 | A1 | 1/2016 | Kadoriku et al. | |
| 2016/0065921 | A1 | 3/2016 | Sieler et al. | |
| 2016/0265733 | A1 | 9/2016 | Bauer et al. | |
| 2017/0261881 | A1* | 9/2017 | Yamamura | G03G 15/04036 |
| 2018/0010756 | A1 | 1/2018 | Knittel et al. | |
| 2018/0320852 | A1 | 11/2018 | Mandl | |
| 2018/0335191 | A1* | 11/2018 | Stefanov | F21S 41/635 |
| 2019/0032880 | A1* | 1/2019 | Kim | F21S 41/153 |
| 2021/0164631 | A1* | 6/2021 | Niu | F21S 41/143 |
| 2021/0215314 | A1* | 7/2021 | Schreiber | F21S 41/151 |

OTHER PUBLICATIONS

European Search Report for EP Application No. 18187731, dated Feb. 8, 2019. (1 page).

* cited by examiner

PROJECTION APPARATUS, LIGHTING MODULE AND MOTOR VEHICLE HEADLAMP CONSISTING OF MICRO-OPTICAL SYSTEMS

The invention relates to a projection apparatus for a light module of a motor vehicle headlamp, which is formed from a multiplicity of micro-optical systems arranged in a matrix-like manner, wherein each micro-optical system has a micro-entrance optical element, a micro-exit optical element assigned to the micro-entrance optical element and a micro-diaphragm arranged between the micro-entrance optical element and the micro-exit optical element, preferably consists of these elements, wherein all micro-entrance optical elements form an entrance optical element, all micro-exit optical elements form an exit optical element and all micro-diaphragms form a diaphragm device, wherein the diaphragm device is arranged in one (exactly one) plane, which is substantially orthogonal to the main radiation direction of the projection apparatus,—in an intermediate image plane—(i.e. all micro-diaphragms lie in the same intermediate image plane) and the entrance optical element, the exit optical element and the diaphragm device are arranged in planes which are substantially parallel to one another.

Furthermore, the invention relates to a light module having at least one above-mentioned projection apparatus and a motor vehicle headlamp having at least one such light module.

Projection apparatuses of the above-mentioned type are known from the prior art (cf. WO 2015/058227 A1, WO 2017/066817 A1, WO 2017/066818 A1). Projection apparatuses of this type are often used in so-called micro-projection light modules for motor vehicle headlamps. The name "micro-projection light module" is thanks to the characteristic size of the individual optical elements—micro-optical elements or the micro-lenses. This size, for example the diameter of the light entrance surface or the light exit surface of these optical elements, preferably lies in the micrometre, particularly in the sub-millimetre range. The above-mentioned micro-entrance optical elements and micro-exit optical elements may likewise have a characteristic size, for example diameters of their light entrance surfaces in the micrometre, preferably in the sub-millimetre range. It is noted in this case that the micro-optical elements—micro-entrance optical element and/or micro-exit optical elements—may be constructed differently.

The international application of the applicant, WO 2015/058227 A1, shows a micro-projection light module for a motor vehicle headlamp, comprising at least one light source and at least one projection apparatus, which images the light exiting from the at least one light source into a region in front of the motor vehicle in the form of at least one light distribution, wherein the projection apparatus comprises: an entrance optical element, which consists of an array of micro-entrance optical elements; an exit optical element, which consists of an array of micro-exit optical elements, wherein exactly one micro-exit optical element is assigned to each micro-entrance optical element, wherein the micro-entrance optical elements are constructed in such a manner and/or the micro-entrance optical elements and the micro-exit optical elements are arranged in such a manner with respect to one another, that the light exiting from one micro-entrance optical element enters exactly only into the assigned micro-exit optical element, and wherein the light pre-shaped by the micro-entrance optical elements is imaged by the micro-exit optical elements into a region in front of the motor vehicle as at least one light distribution.

In the international application, WO 2017/066817 A1, of the applicant, a micro-projection light module for a vehicle headlamp is the subject, which comprises at least one light source and at least one projection apparatus, which images the light exiting from the at least one light source into a region in front of the motor vehicle in the form of at least one light distribution, wherein the projection apparatus comprises an entrance optical element, which has one, two or more micro-entrance optical elements, which are preferably arranged in an array, and an exit optical element, which has one, two or more micro-exit optical elements, which are preferably arranged in an array, wherein exactly one micro-exit optical element is assigned to each micro-entrance optical element, wherein the micro-entrance optical elements are constructed in such a manner and/or the micro-entrance optical elements and the micro-exit optical elements are arranged in such a manner with respect to one another, that essentially all of the light exiting from one micro-entrance optical element enters exactly only into the assigned micro-exit optical element, and wherein the light pre-shaped by the micro-entrance optical elements is imaged by the micro-exit optical elements into a region in front of the motor vehicle as at least one light distribution.

Furthermore, the international application, WO 2017/066818 A1, of the applicant, shows a micro-projection light module for a motor vehicle headlamp, comprising at least one light source and at least one projection apparatus, which images the light exiting from the at least one light source into a region in front of the motor vehicle in the form of at least one light distribution, wherein the projection apparatus comprises an entrance optical element, which has one, two or more micro-entrance optical elements, which are preferably arranged in an array, an exit optical element, which has one, two or more micro-exit optical elements, which are preferably arranged in an array, wherein exactly one micro-exit optical element is assigned to each micro-entrance optical element, wherein the micro-entrance optical elements are constructed in such a manner and/or the micro-entrance optical elements and the micro-exit optical elements are arranged in such a manner with respect to one another, that essentially all of the light exiting from one micro-entrance optical element enters exactly only into the assigned micro-exit optical element, and wherein the light pre-shaped by the micro-entrance optical elements is imaged by the micro-exit optical elements into a region in front of the motor vehicle as at least one light distribution, wherein a first diaphragm device is arranged between the entrance optical element and the exit optical element.

The entrance optical element, exit optical element and diaphragm device of a projection apparatus of the above-mentioned type can be applied, for example pressed or adhesively bonded, onto a common substrate made from glass or plastic. For further details relating to micro-optical systems, reference is made at this point to WO 2015/058227 A1, WO 2017/066817 A1, WO 2017/066818 A1 and further applications of the applicant relating to micro-projection light modules and systems. The entrance optical element, the exit optical element and the diaphragm device in the previously mentioned micro-projection light modules may therefore form a monolithic structure in each case, wherein these structures are aligned with one another in order to be able to project a predetermined light distribution. Preferably, the structures (entrance optical element, exit optical element, diaphragm device) are connected to one another in an immovable manner, for example adhesively bonded, in the state in which they are aligned with one another, in order to prevent misalignments during the journey and subsequent readjustment.

The light distributions generated using micro-projection light modules are formed as an overlay of a multiplicity of micro-light distributions—light distributions which are formed by individual micro-optical systems. If micro-optical systems are combined to form certain micro-optical system groups, then each micro-optical system group is set up for shaping a partial light distribution. The partial light distributions are likewise overlays of a plurality of micro-light distributions. The light distribution or the total light distribution is an overlay of partial light distributions.

One disadvantage of the above-mentioned projection apparatuses or the light modules is for example that setting a sharpness of a light/dark transition, for example the sharpness factor of the cut-off line of the dipped-beam distribution, is very difficult and also cannot be changed dynamically. For example, the optical structure for softening the gradient disclosed in WO 2015031924 A1 can be applied to a surface of a lens by means of milling. The milling may take up to a day in terms of time for one lens.

The sharpness of a light/dark transition or the sharpness factor of a cut-off line is often also termed the gradient of the light/dark transition or the cut-off line.

The object of the present invention is to overcome the disadvantages of the conventional projection apparatuses made from micro-optical systems.

The above-mentioned object is achieved according to the invention with a projection apparatus of the above-mentioned type in that the micro-diaphragm of each micro-optical system has an optically active edge, which is preferably likewise located in the intermediate image plane and which is preferably set up to form/shape the cut-off line of a micro-light distribution, wherein the totality of the micro-optical systems is divided into at least two micro-optical system groups, wherein for the micro-optical systems made from different micro-optical system groups, the optically active edges are positioned differently relative to the respective micro-exit optical elements inside the intermediate image plane.

As is customary, an optically active edge of a diaphragm (a micro-diaphragm) is understood to mean an edge, which is imaged in the light image as a visible light/dark transition, which is relevant for illumination engineering, for example a visible cut-off line. Light/dark transitions, for example cut-off lines, which are relevant for illumination engineering, are usually understood to mean those light/dark transitions which are generated in a targeted fashion, such as boundaries of a light segment or cut-off line of a dipped-beam distribution or similar. One example of a light/dark transition, which is less relevant for illumination engineering, is a soft lateral run-out of a main-beam distribution.

Micro-diaphragms, which are created for example by means of a lithography method, are produced more quickly and can be positioned more precisely than is the case for the above-mentioned milling of an optical structure on a lens surface.

It may advantageously be provided that it is true for each micro-optical system inside the same micro-optical system group that the optically active edge of the micro-diaphragm is displaced relatively to the micro-exit optical element by a distance vertically and/or horizontally and this distance is the same for all micro-optical systems inside the same micro-optical system group, wherein the distance is preferably approximately 0 mm to approximately 0.1 mm, for example approximately 0.01 mm to approximately 0.1 mm, preferably approximately 0.03 mm to approximately 0.06 mm. That is to say, inside the same micro-optical system group, all optically active edges are positioned at the same height relative to the respective micro-exit optical elements.

Should the distance equal 0 mm, then that corresponds to a zero position at which an optically active edge of a micro-diaphragm running horizontally in a straight line is imaged by the corresponding micro-optical system as a micro-cut-off line running horizontally on the H-H line.

Furthermore, it may be provided that the optically active edges of at least a portion of the micro-optical systems of each micro-optical system group are constructed for generating a continuously horizontal or vertical partial cut-off line or a partial cut-off line with an asymmetric rise, wherein each such optically active edge is preferably constructed for generating a continuously horizontal or vertical micro-cut-off line or a micro-cut-off line with an asymmetric rise.

The vertically running cut-off lines or light-dark transitions may for example occur when generating a segmented partial main-beam distribution. There may be a desire to soften vertically running light/dark transitions.

As mentioned above, a generated light distribution formed with the aid of the projection apparatus according to the invention is formed as an overlay of a multiplicity of partial or micro-light distributions. In this case, the following nomenclature applies here: a micro-light distribution is formed with the aid of a single micro-optical system; a partial light distribution is formed with the aid of a micro-optical system group, which partial light distribution is formed as an overlay of individual micro-light distributions formed with the aid of the micro-optical systems of this micro-optical system group; and a light distribution or a total light distribution, for example a dipped-beam distribution, is formed with the aid of the entire projection apparatus and is an overlay of individual partial light distributions. For example, the light distributions formed by micro-optical system groups may be constructed to be congruent to one another, particularly constructed the same (have the same shape), but displaced with respect to one another. The terms micro-cut-off line, partial cut-off line and cut-off line should be configured analogously. A micro-cut-off line is created with the aid of a single micro-diaphragm. A partial cut-off line is created as an overlay of micro-cut-off lines, which are created with the aid of the micro-diaphragms of one and the same micro-optical system group. A cut-off line of the light distribution or the total light distribution is created as an overlay of partial cut-off lines, which is created with the aid of the micro-optical system groups forming the projection apparatus.

Furthermore, it may be expedient if the micro-diaphragms of each micro-optical system group are combined to form a micro-diaphragm group and the micro-diaphragm groups are constructed identically, wherein each micro-diaphragm is preferably constructed as a small plate made from a non-transparent material with an opening.

It may be provided in an embodiment that in different micro-optical system groups, the micro-entrance optical elements are positioned at the same height relative to the respective micro-exit optical elements and preferably have a common optical axis. In this embodiment, the different micro-optical system groups have different intermediate images, which are created due to the displacement of the respective micro-diaphragms. In this case, a light distribution or a total light distribution is created as an overlay of a multiplicity of micro-light distributions with differently positioned micro-cut-off lines (for example displaced vertically and/or horizontally with respect to one another).

It is noted at this point that the horizontal and vertical displacement may be different. In this case, for example, the sharpness of the horizontally and vertically running light/dark transitions are set differently, for example softened. For example, it may sometimes be expedient to soften vertical boundaries of a segment of a partial main-beam distribution differently from the horizontal boundaries of the segment.

In a further embodiment, it may be provided that in different micro-optical system groups, the optically active edges are positioned at the same height relative to the respective micro-entrance optical elements, wherein the micro-entrance optical elements preferably have differently running optical axes (for example displaced vertically and/or horizontally with respect to one another) relative to the respective micro-exit optical elements. Consequently, in this embodiment, the different micro-optical system groups may have identical intermediate images.

Furthermore, the micro-exit optical elements of the different micro-optical system groups in this embodiment are positioned differently (for example displaced vertically and/or horizontally with respect to one another). Therefore, the intermediate images (identical or different) of the different micro-optical system groups are projected at different angles with respect to the optical axis of the projection apparatus. Thus, a light distribution or a total light distribution is formed in this case as an overlay of a multiplicity of micro-light distributions with micro-cut-off lines positioned at the same height, wherein the micro-light distributions are displaced with respect to one another in terms of height (positioned differently, for example displaced vertically and/or horizontally with respect to one another).

Furthermore, it may be provided that the micro-optical systems have an image scale of approximately 3° per 0.1 mm. Other values of the image scale are possible.

In addition, it may be expedient if the different micro-optical system groups are constructed separately from one another and preferably spaced from one another. Further manufacturing advantages may result in this case. Furthermore, in the case of an adaptation of a distance between the different micro-optical system groups, the crosstalk may be reduced.

It is understood that the different micro-optical system groups may also be monobloc. In this case, the micro-entrance optical elements, micro-exit optical elements and micro-diaphragms of each micro-optical system group may form a monolithic structure in each case. They may for example be applied to one or more glass or plastic substrate(s) and/or adhesively bonded to one another.

The above-mentioned object is also achieved using a light module for a motor vehicle headlamp with a projection apparatus according to the invention, wherein the light module furthermore comprises a light source, preferably a semiconductor-based light source, particularly an LED light source, and the projection apparatus is downstream of the light source in the light radiation direction and the, preferably essentially total, light generated by the light source is projected with a cut-off line into a region in front of the light module in the form of a light distribution, for example a near field light distribution or a dipped-beam distribution with or without a sign-light distribution, wherein the light distribution is formed from a multiplicity of mutually overlapping partial light distributions with a partial cut-off line in each case, wherein each partial light distribution is formed by exactly one micro-optical system group and the partial cut-off lines together form the cut-off line.

Therefore, the partial cut-off lines of different partial light distributions are arranged differently (for example displaced vertically and/or horizontally with respect to one another).

Furthermore, it may prove expedient, if the partial cut-off lines are displaced by an angle with respect to one another along a vertical (with regards to a H-H line) and/or a horizontal (with regards to a V-V line), wherein the angle has a value of approximately 0° to approximately 6°, for example approximately 1° to approximately 3°, preferably of approximately 2°.

The term H-H line should be clear to the person skilled in the art. A horizontal line (an abscissa axis) of a coordinate system on a measuring screen for measuring the light distributions created by motor vehicle headlamps or motor vehicle headlamp light modules in an illumination engineering laboratory is typically termed a H-H line. H-H line is often also termed the horizon or the horizontal. An ordinate axis orthogonal to the H-H line is termed a V-V line or vertical.

In a practically proven embodiment, it may be provided that the partial cut-off lines (and ergo the cut-off line) run substantially in a straight line or have an asymmetric rise.

Preferably, the light source is set up to generate collimated light.

Actually, the light source may comprise a light-collimating optical element and a preferably semiconductor-based lamp element, which is upstream of the light-collimating optical element, for example an LED light source (made from a plurality of, preferably individually controllable LEDs), wherein the light-collimating optical element is for example a collimator or a light-collimating adapter optical element (e.g. made from silicon) or a TIR lens. "TIR" stands for "total internal reflection".

In a particularly advantageous design of the light module, it may be provided that the light source has at least two light-emitting regions, wherein each individual light-emitting region can be controlled, for example switched on and off, independently of the other light-emitting regions of the light source, and at least one, preferably exactly one micro-optical system group, is assigned to each light-emitting region in such a manner that light generated by the respective light-emitting region impinges directly (i.e. without being refracted, reflected, diverted on further optically active surfaces, elements or the like, or changing its intensity and/or propagation direction in another manner) and only onto the micro-optical system group assigned to this light-emitting region.

In the following figures—insofar as not otherwise specified—the same reference numbers label the same features.

The invention, together with further advantages is explained in more detail in the following on the basis of exemplary embodiments, which are shown in the drawing. In the figures FIG. 1 shows an illumination device with a projection apparatus made from a plurality of micro-optical systems in a perspective view;

FIG. 1*a* shows an exploded illustration of one of the micro-optical systems of FIG. 1;

FIG. 1*b* shows a section A-A of the micro-optical system of FIG. 1*a;*

FIG. 2*a* shows an illumination device with a light source with a plurality of light-emitting regions and with a projection apparatus with micro-optical system groups arranged next to one another in a perspective view;

FIG. 2*b* shows an enlarged cutout of a projection apparatus with micro-optical system groups arranged above one another;

Figure 5A:
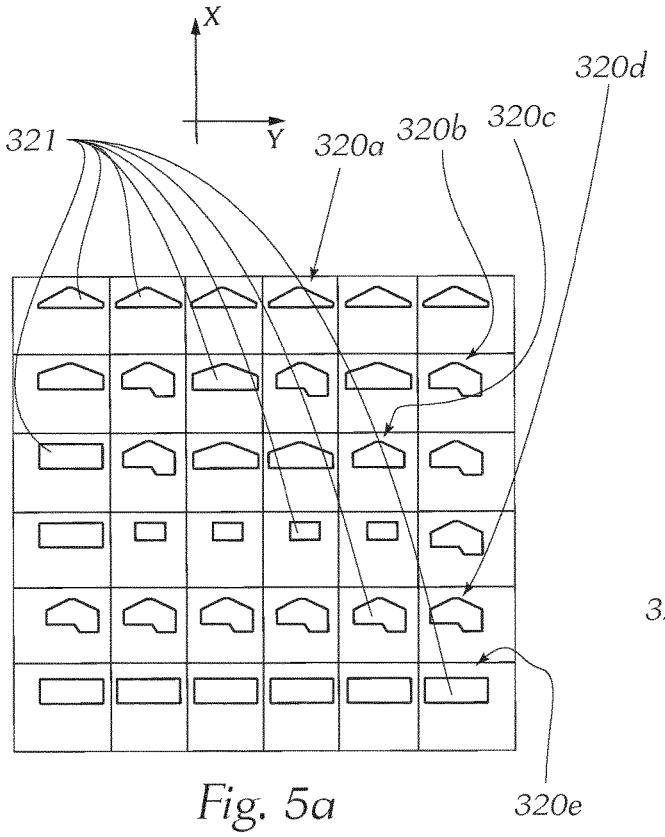
Figure 5B:
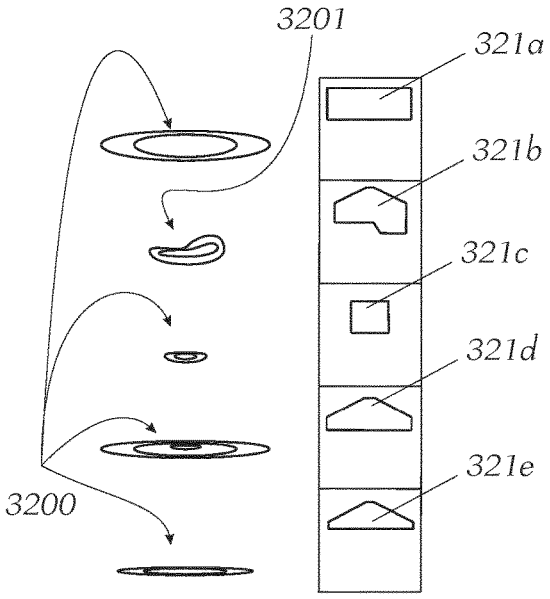
Figure 6:
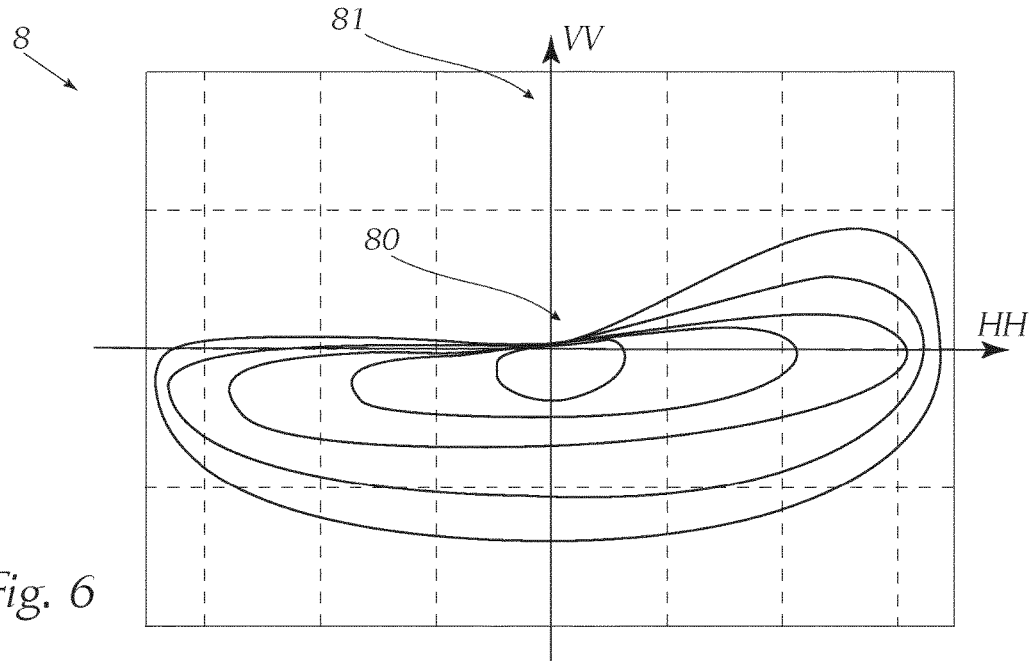

FIG. 5*a* shows a micro-diaphragm group;

FIG. 5*b* shows a cutout of the micro-diaphragm group of FIG. 5*a* and micro-light distributions, and FIG. 6 shows a dipped-beam distribution with sign-light distribution.

The figures are schematic illustrations, which only show those constituents which may be helpful for an explanation of the invention. The person skilled in the art will recognize immediately that a projection apparatus and a light module for a motor vehicle headlamp may have a multiplicity of further constituents, which are not shown here, such as setting and moving apparatuses, electrical supply means and many more.

To facilitate readability and where it is expedient, the figures are provided with reference axes. These reference axes relate to a proper installation position of the subject matter of the invention in a motor vehicle and represent a motor-vehicle-based coordinate system.

Furthermore, it should be clear that direction-related terms, such as "horizontal", "vertical", "top", "bottom", etc. are to be understood in a relative meaning in connection with the present invention and relate either to the above-mentioned proper installation position of the subject matter of the invention in a motor vehicle or to a proper alignment of a radiated light distribution in the light image or in the traffic space.

Thus, neither the reference axes nor the direction-related terms are to be construed as limiting.

Figure 1:
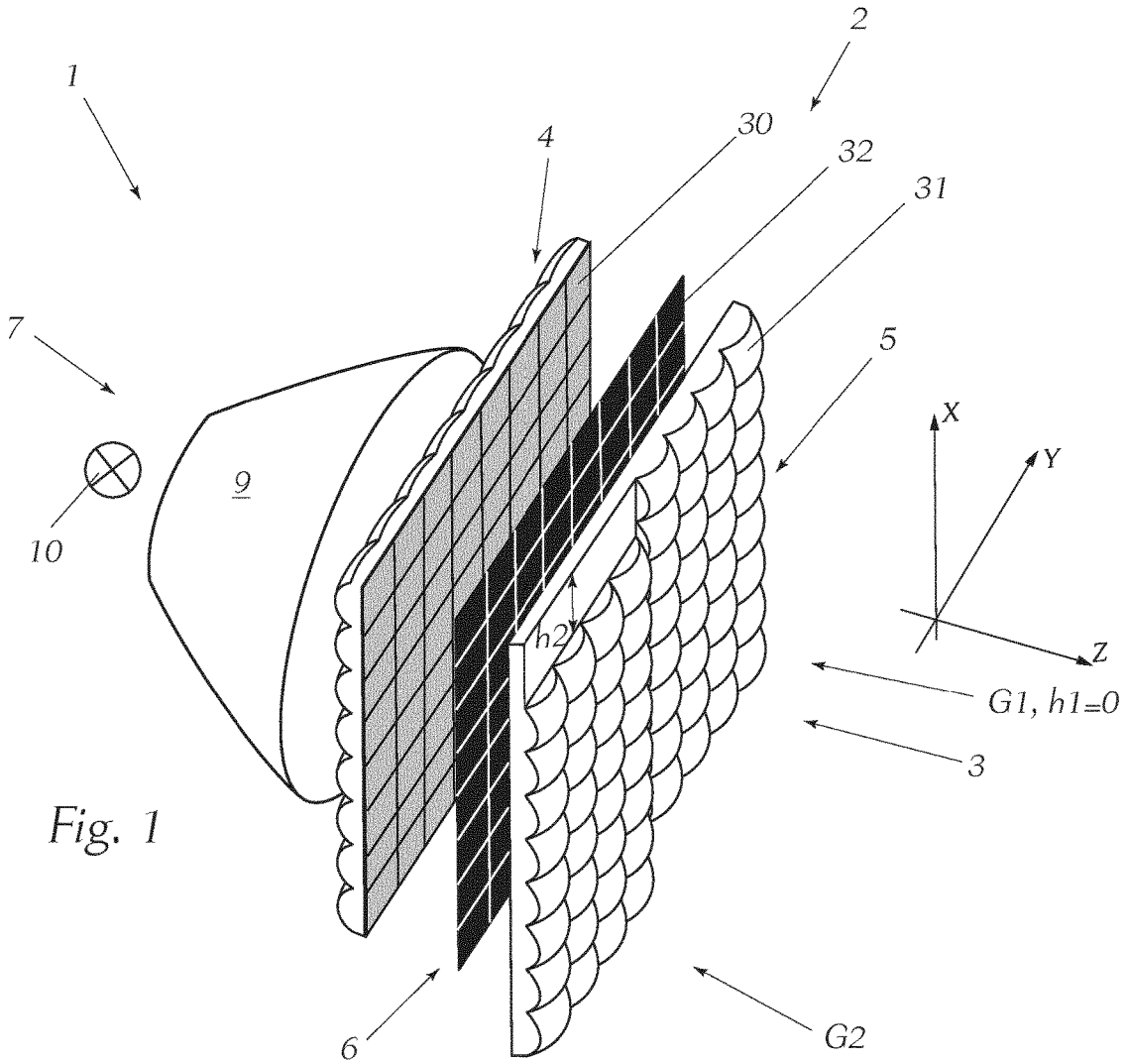

FIG. 1 shows an illumination device 1 for a motor vehicle headlamp, which may correspond to the light module according to the invention. The illumination device 1 comprises a projection apparatus 2, which is formed from a multiplicity of micro-optical systems 3 arranged in a matrix-like manner, wherein each micro-optical system 3 has a micro-entrance optical element 30, a micro-exit optical element 31 assigned to the micro-entrance optical element 30 and a micro-diaphragm 32 arranged between the micro-entrance optical element 30 and the micro-exit optical element 31. Preferably, each micro-optical system 3 consists of exactly one micro-entrance optical element 30, exactly one micro-exit optical element 31 and exactly one micro-diaphragm 32 (see an exploded illustration of such a micro-optical system in FIG. 1*a*). In this case, all micro-entrance optical elements 30 form a monobloc entrance optical element 4 for example. Analogously, all micro-exit optical elements 31 form a monobloc exit optical element 5 for example and the micro-diaphragms 32 form a monobloc diaphragm device 6 for example. Thus, the entrance optical element 4, the exit optical element 5 and the diaphragm device form a monobloc projection apparatus 2 for example. An example of a projection apparatus 2 not constructed in a monobloc manner can be seen e.g. from FIG. 3. The diaphragm device 6 is arranged in a plane substantially orthogonal to the main radiation direction Z of the projection apparatus 2—in the intermediate image plane 322. Thus, all micro-diaphragms 32 are likewise located in the intermediate image plane 322. The entrance optical element 4, the exit optical element 5 and the diaphragm device 6 are arranged in planes that are substantially parallel to one another.

Furthermore, the micro-diaphragm 32 of each micro-optical system has an optically active edge 320, 320*a*, 320*b*, 320*c*, 320*d*, 320*e*. Preferably, the optically active edge is likewise in the micro-intermediate image plane 322. The optically active edge 320, 320*a*, 320*b*, 320*c*, 320*d*, 320*e* can be set up or constructed to create a cut-off line of a micro-light distribution—a so-called micro-cut-off line 3200, 3201—(cf. FIG. 5*b*). A micro-light distribution is formed by light passing through the respective micro-optical system 3. Therefore, each micro-optical system 3 preferably shapes exactly one micro-light distribution and vice versa: each micro-light distribution is preferably shaped by exactly one micro-optical system 3. The optically active edge 320, 320*a*, 320*b*, 320*c*, 320*d*, 320*e* may have different shapes. If, as shown in FIG. 1*b*, the micro-diaphragm 32 is constructed as an opening in an otherwise non-transparent small plate, the optically active edge 320, 320*a*, 320*b*, 320*c*, 320*d*, 320*e*, which is constructed as an opening boundary in this case, has a closed shape. In this case, at least a part of the optically active edge 320, 320*a*, 320*b*, 320*c*, 320*d*, 320*e* is set up/constructed for shaping/forming the micro-cut-off line 3200, 3201. In the micro-diaphragms shown in FIGS. 1*a*, 4, 5*a* and 5*b*, this is the lower part of the optically active edge 320, 320*a*, 320*b*, 320*c*, 320*d*, 320*e*.

According to the invention, the totality of the micro-optical systems 3 is divided into at least two micro-optical system groups G1, G2, G3. The individual micro-optical system groups G1, G2, G3 differ in that they comprise micro-optical systems 3, the optically active edges 320, 320*a*, 320*b*, 320*c*, 320*d*, 320*e* of which are positioned differently relatively to the respective micro-exit optical elements 31 inside the intermediate image plane 322, for example are displaced vertically and/or horizontally. In this case, it is expedient, if the position of the optically active edges 320, 320*a*, 320*b*, 320*c*, 320*d*, 320*e* relative to the respective micro-exit optical elements 32 inside the same micro-optical system group G1, G2, G3 is the same.

For example, the micro-diaphragms 32 inside a micro-optical system group, e.g. G1, may be positioned in such a manner in their totality that they do not have any vertical and/or horizontal displacement relative to the respective micro-exit optical elements 31—this leads to centred micro-optical systems 3 for example (see below). If the optically active edges 320*b*, 320*d* of these micro-diaphragms 32 are for example set up to form micro-cut-off lines 3200, 3201 for a dipped-beam distribution, as shown for example in FIG. 6, a partial cut-off line (that is to say the cut-off line which is formed by a micro-optical system group) would be created, which does not have any vertical displacement (with respect to the H-H line HH) and/or horizontal displacement (with respect to a V-V line VV). At the same time, the micro-diaphragms 32 inside a different micro-optical system group, e.g. G2, may be positioned in such a manner in their totality that they are displaced relatively to the respective micro-exit optical elements 31 vertically (shown) and/or horizontally (not shown) by a distance (different from zero), which is why there is a difference between the relative positions of the optically active edges and the respective micro-exit optical elements of different micro-optical system groups G1, G2, G3. Thus, the micro-optical systems 3 of the micro-optical system group G2 of FIG. 1 can be used for creating micro-cut-off lines for a dipped-beam distribution, which are displaced vertically with respect to the H-H line HH, for example. As explained previously, the mutually displaced micro-cut-off lines, which are provided by means of different micro-optical system groups G1, G2, G3, overlap in the light image, as a result of which a soft cut-off line of a dipped-beam distribution, which may be perceived pleasantly for a human eye, may be created.

It should be clear that the above-described example is not limited to cut-off lines of dipped-beam distributions, but rather may be generalized to generic light/dark transitions.

Figure 1A:
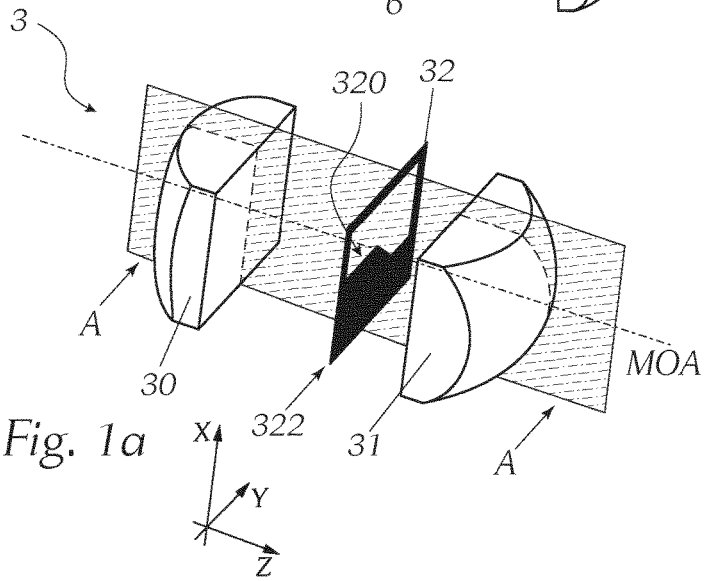
Figure 1B:
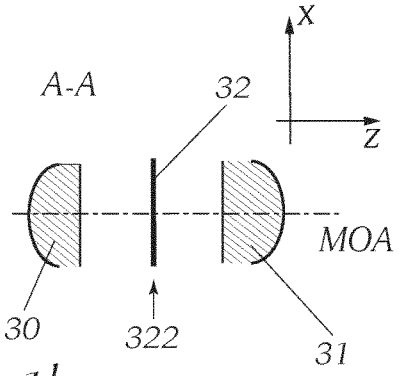

How the positionings at different heights of the optically active edges 320, 320*a*, 320*b*, 320*c*, 320*d*, 320*e* relative to the respective micro-exit optical elements 31 can be achieved may be explained plausibly for example with reference to FIGS. 1*a* and 1*b*. FIG. 1*a* shows a single micro-optical system 3 in a perspective view. FIG. 1*b* shows a section A-A of FIG. 1*a*. The micro-optical system 3 shown in these figures is centred: the micro-entrance optical element 30 and the micro-exit optical element 31 have a common optical axis MOA and the micro-diaphragm 32 is positioned in such a manner in the micro-intermediate image plane 322 that its optically active edge 320, which is clearly shaped here to form a micro-cut-off line with an asymmetric rise, adjoins the optical axis MOA of the micro-optical system 3. This means that a collimated light beam, which is incident onto the centred micro-optical system 3 (from the side of micro-entrance optical element 30) shown in FIG. 1*a*, is imaged in the form of a micro-light distribution with a micro-cut-off line lying at least partially on the H-H line. Such centred micro-optical systems may for example be combined to form a micro-optical system group, such as the micro-optical system group G1 in FIG. 1.

If one for example displaces either the micro-diaphragm 32 or the micro-exit optical element 31 of FIGS. 1*a*, 1*b* vertically (along the X direction). A horizontal displacement (along the Y direction), which is not shown here, is likewise conceivable. In the case of the displacement of the micro-exit optical element 31, either the entire micro-optical system 3 is decentred—the optical axes of the micro-entrance optical element 30 and the micro-exit optical element 31 no longer coincide. In both cases, the micro-cut-off line of the micro-light distribution is also displaced. Such "not ideally centred" micro-optical systems may for example be combined to form a further micro-optical system group, such as the micro-optical system group G2 in FIG. 1. Vertical and/or horizontal displacement also means that the optically active edges and the micro-exit optical elements remain in their original planes.

Figure 2A:
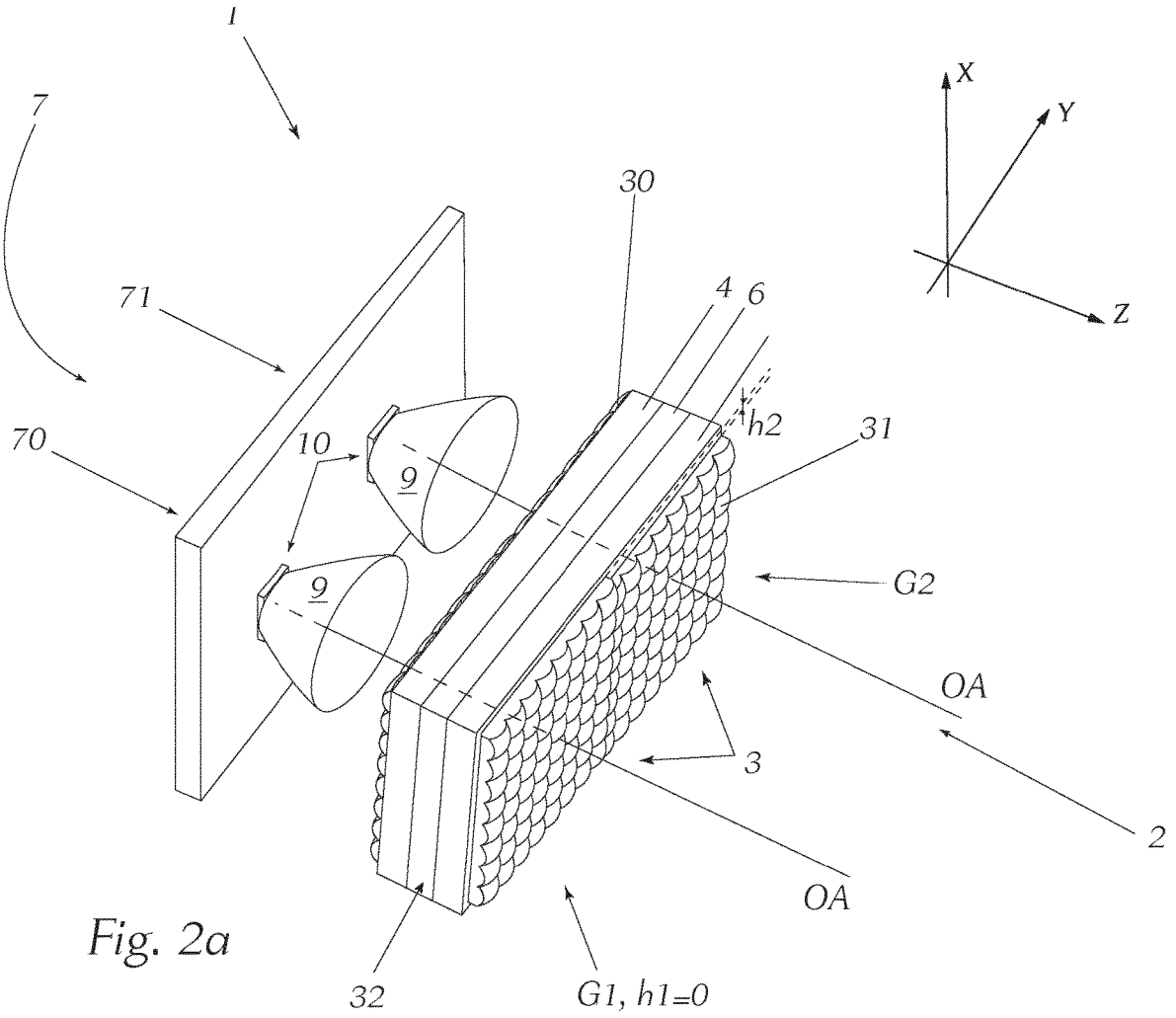

Returning to FIG. 1, this shows two micro-optical system groups G1, G2, G3 arranged next to one another, wherein one of the micro-optical system groups—namely the micro-optical system group G2—is formed from decentred micro-optical systems (the micro-exit optical elements 31 are displaced downwards by a distance h2), (see also FIG. 2*a*).

Figure 2B:
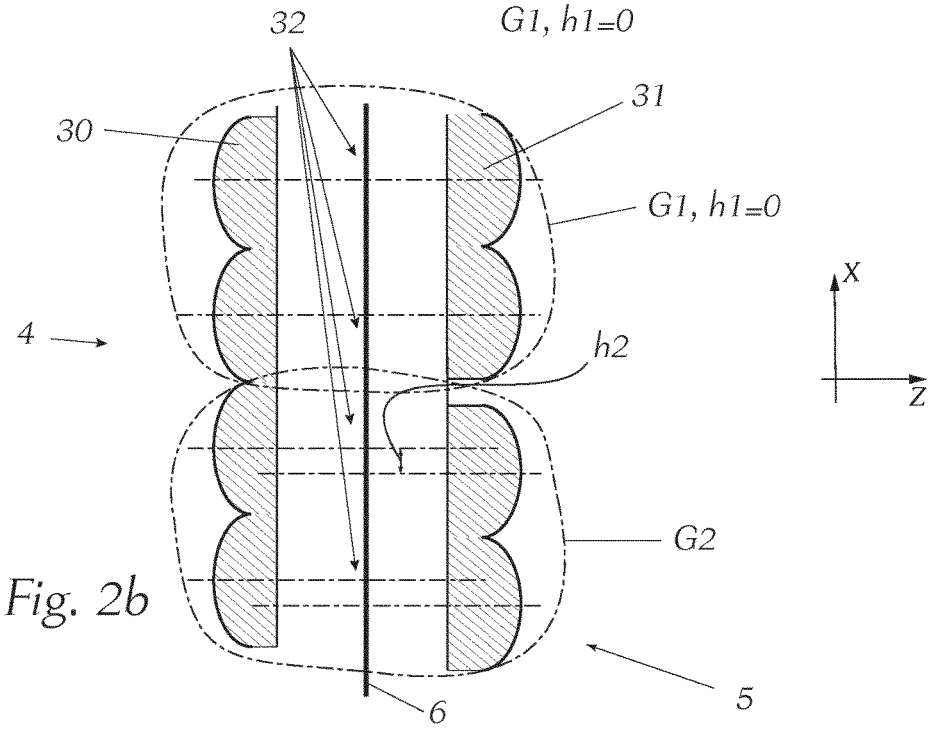

The different micro-optical system groups G1, G2, G3 may also be arranged above or below one another, as can be seen in FIG. 2*b*.

The projection apparatus 2 may also comprise a plurality of micro-optical system groups.

For each individual micro-optical system group G1, G2, G3, it may be expedient if it is true for each micro-optical system 3 inside this one micro-optical system group G1, G2, G3, that the optically active edge 320, 320*a*, 320*b*, 320*c*, 320*d*, 320*e* of the micro-diaphragm 32 is displaced vertically by the distance h1, h2 relatively to the micro-exit optical element 31 and this distance h1, h2 is the same for all micro-optical systems 3 inside the same micro-optical system group G1, G2, G3, wherein the distance h1, h2 is preferably approximately 0 mm (see the micro-optical system group G1 of FIG. 1, 2*a*) to approximately 0.1 mm, for example approximately 0.01 mm to approximately 0.1 mm, preferably approximately 0.03 mm to approximately 0.06 mm.

A distance, which is equal to zero, such as for example h1 in FIG. 1 or 2*a*, corresponds to a zero position of the optically active edge 320, 320*a*, 320*b*, 320*c*, 320*d*, 320*e* and results if the micro-optical systems 3 are centred (see above). Using an optically active edge 320, 320*a*, 320*b*, 320*c*, 320*d*, 320*e* arranged in the zero position, a micro-cut-off line lying at 0° on the V-V line VV (ordinate axis which is orthogonal to the H-H line HH) can be created.

Figure 4:
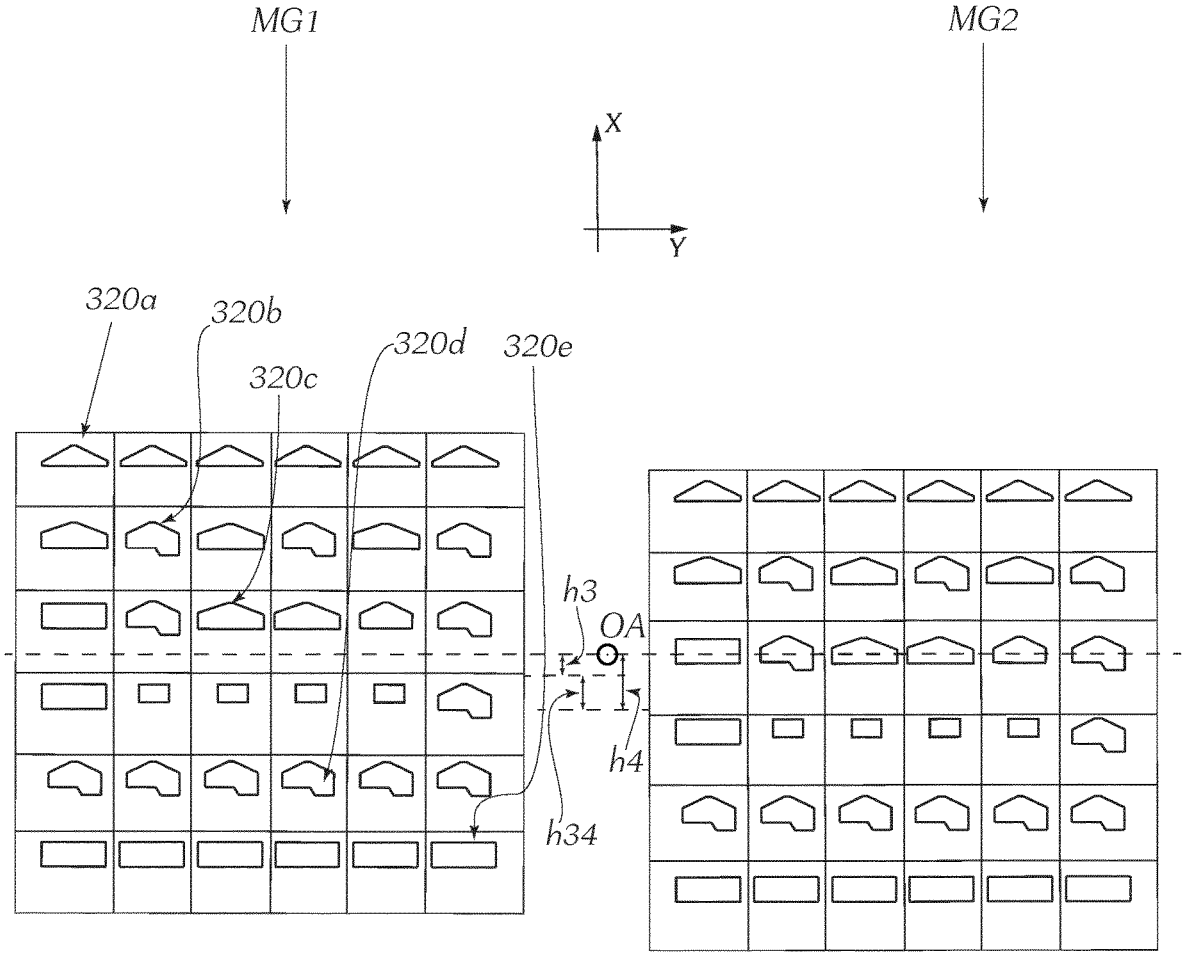
FIG. 4 shows two micro-diaphragm groups arranged next to one another.

As mentioned previously, the optically active edges of at least a portion of the micro-optical systems 3 of each micro-optical system group G1, G2, G3 may be constructed to create a continuously horizontal cut-off line 3200—e.g. the edges 320*a*, 320*c* or 320*e* in FIG. 4 or in FIG. 5*a*—or a cut-off line with an asymmetric rise 3201—e.g. the edges 320*b* and 320*d* in FIG. 4 or in FIG. 5*a*.

Furthermore, it can be seen from FIG. 4 that the micro-diaphragms 32 of each micro-optical system group G1, G2, G3 can be combined to form (exactly) one micro-diaphragm group MG1, MG2, wherein the micro-diaphragm groups MG1, MG2 are constructed identically. It is conceivable that all micro-diaphragms 32 of the projection apparatus 2 are constructed identically.

In particular, it can be seen in FIGS. 1*a*, 4, 5*a* and 5*b* that each micro-diaphragm 32 can be constructed as a small plate made from a non-transparent material with an opening 321, 321*a*, 321*b*, 321*c*, 321*d*, 321*e*. As mentioned previously, the inner boundaries of the openings may form optically active edges. In this case, the lower part of the optically active edge can be set up/constructed for shaping/forming a micro-cut-off line for a dipped-beam distribution.

As mentioned previously, the micro-entrance optical elements 30 of different micro-optical system groups G1, G2, G3 are positioned at the same height relative to the respective micro-exit optical elements 31 and preferably have a common optical axis OA. In this case, the micro-diaphragms which belong to different micro-optical system groups G1, G2, G3 and can be combined in different micro-diaphragm groups MG1, MG2, are positioned differently (for example displaced vertically and/or horizontally with respect to one another). It can be seen from FIG. 4 that a micro-diaphragm group—here the first micro-diaphragm group MG1—is displaced by a distance h3 (downwards) with regards to the (common) optical axis OA. In this case, a different micro-diaphragm group—here the second micro-diaphragm group MG2—may be displaced by a different distance h4 with regards to the (common) optical axis OA.

FIG. 4 shows an example, in which the micro-diaphragm groups MG1, MG2 are displaced in the same direction. It is understood that the micro-diaphragm groups may be displaced in different vertical directions (upwards or downwards). A relative distance h34 results between the distances h3, h4. The micro-diaphragm groups may also be displaced in (different) horizontal directions (not shown).

As mentioned previously, FIGS. 1, 2*a*, 2*b* show exemplary embodiments, in which in different micro-optical system groups, G1, G2, G3, the optically active edges 320, 320*a*, 320*b*, 320*c*, 320*d*, 320*e* are positioned at the same height relative to the respective micro-entrance optical elements, wherein the micro-entrance optical elements 30 preferably have differently running optical axes (for example displaced vertically and/or horizontally with respect to one another) relative to the respective micro-exit optical elements 31—that is to say are decentred.

The micro-optical systems 3 may for example have an image scale of approximately 3° per 0.1 mm. Other image scales are conceivable and depend on the respective design of the micro-optical systems 3. That is to say that a relative displacement of the optically active edge 320, 320*a*, 320*b*, 320*c*, 320*d*, 320*e* to the micro-exit optical element 31 in such a micro-optical system 3 by approximately 0.1 mm leads to a displacement of a light/dark transition, for example a micro-cut-off line, created by this optically active edge 320, 320*a*, 320*b*, 320*c*, 320*d*, 320*e* by approximately 3° along the V-V line VV (that is to say in angular space).

At this point, it is noted that the different micro-optical system groups G1, G2, G3 can be constructed separately from one another and preferably spaced from one another. This can be seen in FIG. 3 for example.

The illumination device 1 additionally has a light source 7, preferably a semiconductor-based light source, particularly an LED light source, wherein the projection apparatus 2 is downstream of the light source 7 in the light radiation direction Z and the, preferably essentially total, light generated by the light source 7 is projected with a cut-off line 80 into a region in front of the illumination device 1 in the form of a light distribution, for example a near field light distribution or a dipped-beam distribution 8 with or without a sign-light distribution 81 (see FIG. 6). The light distribution is usually formed from a multiplicity of mutually overlapping partial light distributions with one partial cut-off line in each case, wherein each partial light distribution is formed by exactly one micro-optical system group G1, G2, G3 and the partial cut-off lines together form the cut-off line. The partial cut-off lines are for their part formed from a multiplicity of micro-cut-off lines. Furthermore, it follows from the aforesaid, that the partial cut-off lines of different partial light distributions are arranged differently (for example displaced vertically and/or horizontally with respect to one another).

In this case, the partial cut-off lines may be displaced by an angle with respect to one another along the vertical (V-V line VV) or along the horizontal/the horizon (H-H line HH), wherein the angle has a value of approximately 0° to approximately 3°, for example approximately 1° to approximately 3°, preferably of approximately 2°. As a result, an overlay of partial light distributions with differently positioned partial cut-off lines (for example displaced vertically and/or horizontally with respect to one another) is created in the light image. The partial cut-off lines (and ergo the cut-off line of the entire light distribution) may for example run essentially straight or have an asymmetric rise 80.

The light source 7 may be set up to generate collimated light.

Therefore, the light source 7 may have a light-collimating optical element 9 and comprise a semiconductor-based lamp element 10, for example an LED light source, which is upstream of the light-collimating optical element 9 and for example consists of a plurality of, preferably individually controllable, LEDs. In this case, the light-collimating optical element 9 is for example a collimator or a light-collimating adapter optical element (e.g. made from silicon) or a TIR lens.

Figure 3:
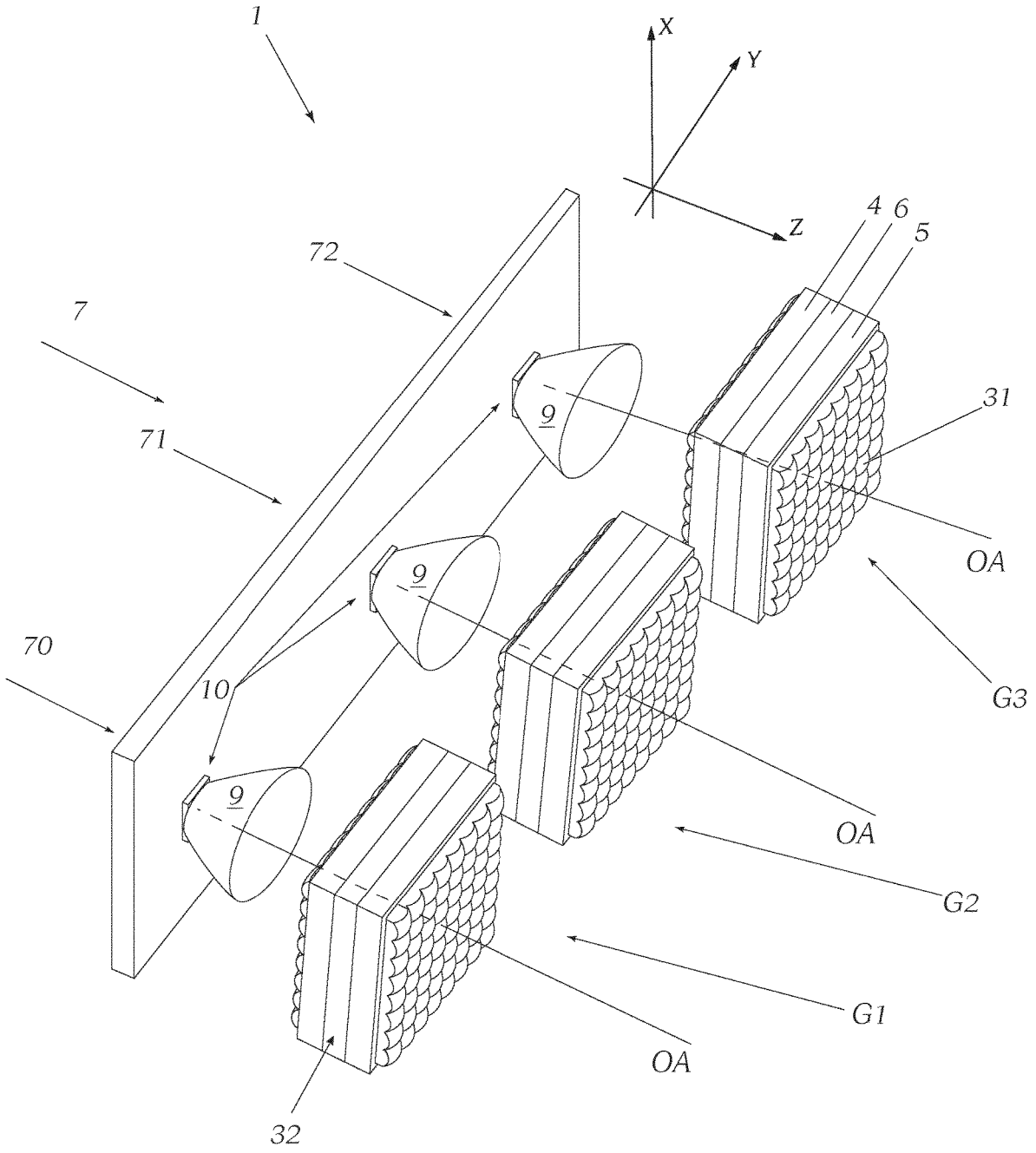
FIG. 3 shows an illumination device with a light source with a plurality of light-emitting regions and with a plurality of projection apparatuses in a perspective view.

As can be seen in FIGS. 2*a* and 3, the light source 7 may have two or more light-emitting regions 70, 71, 72, wherein each individual light-emitting region can be controlled, for example switched on and off, independently of the other light-emitting regions of the light source 7.

Furthermore, at least one, preferably exactly one, micro-optical system group G1, G2, G3 can be assigned to each light-emitting region 70, 71, 72 in such a manner that light generated by the respective light-emitting region 70, 71, 72 impinges directly, i.e. without being refracted, mirrored, diverted on further optically active surfaces, elements or the like, or changing its intensity and/or propagation direction in another manner, and only onto the micro-optical system group G1, G2, G3 assigned to this light-emitting region 70, 71, 72.

In this case, FIG. 2*a* shows two micro-optical system groups G1 and G2 of monobloc construction. In this case, the corresponding micro-entrance optical elements, micro-diaphragms and micro-exit optical elements can be applied to one and the same glass substrate.

It can be seen in FIG. 3 that the light source 7 can have three light-emitting regions 70, 71, 72, to which three micro-optical system groups G1, G2, G3 are assigned, which are constructed separately from one another and are preferably spaced from one another. In this case, exactly one micro-optical system group G1, G2, G3 is assigned to each individual light-emitting region 70, 71, 72 in each case. Each individual light-emitting region can be controlled, for example switched on and off, independently of the other light-emitting regions of the light source 7. The micro-optical system group G1, G2, G3 assigned to each light-emitting region 70, 71, 72 is preferably arranged in such a manner that light generated by the respective light-emitting region 70, 71, 72 impinges onto it directly, i.e. without being refracted, mirrored, diverted on further optically active surfaces, elements or the like, or changing its intensity and/or propagation direction in another manner.

The light-emitting regions 70, 71, 72 may for example be constructed as semiconductor-based light sources and comprise one or more LED light sources in particular.

Using a projection apparatus according to the invention, it is for example possible to set, preferably to reduce, the sharpness factor (also termed the "gradient") of a cut-off line of a dipped-beam distribution or, in general, sharpness of a light/dark transition of a light distribution. This particularly has an advantage if a characteristic size of the micro-entrance optical elements and the micro-exit optical elements, for example the diameter of their light entrance surfaces lies in the micrometre, preferably in the sub-millimetre range. For optical elements/lenses of this size, a softening of the gradient (reduction of the sharpness factor) by means of conventional methods, such as for example applying an optical structure onto light-exit surfaces of the optical elements, is extremely difficult. The sharpness factor can be reduced by means of an above-described projection apparatus according to the invention.

It is noted at this point, that according to ECE regulation no. 112, the sharpness factor currently lies between 0.13 (minimum sharpness) and 0.40 (maximum sharpness).

Furthermore, the light modules according to the invention enable not only a static softening of the gradient (see above), but also a dynamic setting, preferably reduction of the sharpness factor. Dynamic setting is understood to mean setting during the operation of the light module. Examples of light modules which enable dynamic setting are the light modules with a light source having a plurality of light-emitting regions, wherein the light-emitting regions are individually controllable, as described above. For example, the illumination devices of FIGS. 2*a* and 3 constitute examples of light modules which enable dynamic setting of the sharpness factor. In this case, as mentioned previously, one or more micro-optical system group(s) can be assigned to a light-emitting region, which may for example be constructed as a semiconductor-based light source. Such a system: light-emitting region and at least one micro-optical system group assigned to the light-emitting region can be set to a predetermined sharpness factor, i.e. set up to generate a partial light distribution with a cut-off line with a predetermined sharpness factor. For example, a light module is conceivable, which comprises three such systems having a sharpness factor of approximately 0.35 and one system with a sharpness factor of approximately 0.19. It has been established that in a state, in which all four systems of the light module are switched on, a light distribution with a cut-off line with a sharpness factor of approximately 0.28 results. Furthermore, it has been established, that a light module with three systems with a sharpness factor of approx. 0.19 and one system with a sharpness factor of approx. 0.35 generates a light distribution with a cut-off line with a sharpness factor of approx. 0.21, if all four systems are switched on. These examples make it possible to see that a light module with a plurality of such systems, which have different sharpness factors, a dynamic setting—reduction and increase—of the cut-off line of a light distribution, and in general, the sharpness of a cut-off line of a light distribution, is possible. Thus, a variable, preferably driving-situation-dependent sharpness factor can be realized. This may be advantageous in the most diverse of driving situations. In a dark environment (for example on country roads), a softer (smaller) sharpness factor is advantageous in order to configure the light/dark transition, preferably the cut-off line, of a dipped-beam distribution more pleasantly. On the other hand, a soft sharpness factor hides a danger that oncoming traffic and/or pedestrians are dazzled more. In the city, with environmental lighting, it may therefore be advantageous to switch to a harder (higher) sharpness factor.

The relative position according to the invention of the optically active edges 320, 320*a*, 320*b*, 320*c*, 320*d*, 320*e* to the respective micro-exit optical elements 31 inside the intermediate image plane can be calculated as a function of a predetermined gradient. As a result, in light modules for example, a softening of the gradient (the sharpness factor) can be achieved.

In conventional illumination devices, the gradient can for example be softened by applying an optical structure onto a lens surface (cf. e.g. WO 2015031924 A1 of the applicant). In this case, one starts from an original (unmodified) light distribution, which has a cut-off line or a light/dark transition with a gradient, which it is worth softening. The aim—the softened gradient—is predetermined. A scattering function is calculated/determined on the basis of this specification. By folding the unmodified light distribution with this scattering function, a modified light distribution is created, which has the softened gradients according to the specification. The scattering function plays the role of a weighting function in this case. The optical structure—in the case of WO 2015031924 A1—the shape of individual elevations on the lens surface, is also calculated on the basis of the scattering function. The optical structure (the individual elevations) is applied onto the lens surface according to this calculation.

As described previously, the sharpness factor in the present invention can be influenced by different relative positions of the optically active edges 320, 320*a*, 320*b*, 320*c*, 320*d*, 320*e* to the respective micro-exit optical elements 31. The expensive application of the optical structure onto lens surfaces (milling of one such structure may take up to a day in terms of time for one lens) is therefore no longer necessary. As also described in the above-described method, a gradient is predetermined as target, which for the most part is smaller than the gradient of the unmodified light distribution. A scattering function is calculated/determined on the basis of this specification. This scattering function can then be converted to the relative position of the optically active edges 320, 320*a*, 320*b*, 320*c*, 320*d*, 320*e* to the respective micro-exit optical elements 31 inside the intermediate image plane for all micro-optical system groups G1, G2, G3, so that when folding an original (unmodified) light distribution with this scattering function, the light distribution, which has the predetermined gradient, is created. In this case, the basic idea is that a displacement of an optically active edge from its zero position relative to the respective micro-exit optical element causes a corresponding displacement, which is dependent on an image scale for example, of the light distribution or the light image. The zero position is understood to mean a position, in which the optically active edge to the corresponding micro-exit optical element is not displaced and for example is imaged in a micro-dipped-beam distribution as a non-displaced cut-off line. Because a discrete (finite) number of optically active edges is normally present, the folding may be understood as a sum (superimposition) of micro-light distributions (micro-main-beam distributions or micro-dipped-beam distributions) which are correspondingly displaced with respect to one another.

As explained previously, a displacement of the micro-diaphragm relatively to the respective micro-exit optical element represents a displacement of the light image which is dependent on the image scale. Owing to this relationship, the scattering function, which represents a predetermined change of the gradient, can be converted from angle coordinates in the spherical coordinate system ([°]) into Cartesian coordinates [mm]. On the basis of the representation of the scattering function in Cartesian coordinates, it is possible to determine the relative position of the optically active edges 320, 320*a*, 320*b*, 320*c*, 320*d*, 320*e* to the respective micro-exit optical elements 31 inside the intermediate image plane in each micro-optical system group G1, G2, G3 and the number of micro-optical systems in each micro-optical system group G1, G2, G3.

For example, a displacement of a light distribution by 2° may correspond to a displacement of the micro-diaphragm by 0.06 mm.

The intensity values may correspond to the number of micro-optical systems in the respective micro-optical system group G1, G2, G3 in this case. That is to say the candela weighting factors are converted to a number of different positions.

The reference numbers in the claims are used solely for better understanding of the present inventions and in no way mean a limitation of the present inventions.

Insofar as it does not necessarily result from the description of one of the above-mentioned embodiments, it is assumed that the described embodiments can be combined with one another as desired. Among other things, this means that the technical features of an embodiment can be combined with the technical features of a different embodiment individually and independently of one another as desired, in order to achieve a further embodiment of the same invention in this manner.

The invention claimed is:

1. A projection apparatus (2) for a light module (1) of a motor vehicle headlamp, the projection apparatus comprising:

a multiplicity of micro-optical systems (3) arranged in a matrix-like manner, wherein each micro-optical system (3) has a micro-entrance optical element (30), a micro-exit optical element (31) assigned to the micro-entrance optical element (30) and a micro-diaphragm (32), wherein all micro-entrance optical elements (30) form an entrance optical element (4), all micro-exit optical elements (31) form an exit optical element (5) and all micro-diaphragms (32) form a diaphragm device (6), wherein the diaphragm device (6) is arranged in a plane, which is orthogonal to a main radiation direction (Z) of the projection apparatus (2) in an intermediate image plane, and wherein the entrance optical element (4), the exit optical element (5) and the diaphragm device (6) are arranged in planes which are substantially parallel to one another, wherein the micro-diaphragm (32) of each micro-optical system (3) has an optically active edge (320, 320*a*, 320*b*, 320*c*, 320*d*, 320*e*), wherein the totality of the micro-optical systems (3) is divided into at least two micro-optical system groups (G1, G2, G3), wherein for the micro-optical systems (3) made from different micro-optical system groups (G1, G2, G3), the optically active edges (320, 320*a*, 320*b*, 320*c*, 320*d*, 320*e*) are positioned differently relative to the respective micro-exit optical elements (31) inside the intermediate image plane, wherein the micro-diaphragms (32) of each micro-optical system group (G1, G2, G3) are combined to form a micro-diaphragm group (MG1, MG2) and the micro-diaphragm groups (MG1, MG2) are constructed identically, wherein the micro-diaphragm groups (MG1, MG2 are displaced in the vertical direction with respect to one another, and wherein in different micro-optical system groups, (G1, G2, G3), the optically active edges (320, 320*a*, 320*b*, 320*c*, 320*d*, 320*e*) are positioned at the same height relative to the respective micro-entrance optical elements (30), wherein the micro-entrance optical elements (30) have differently running optical axes, relative to the respective micro-exit optical elements (31).

2. The projection apparatus according to claim 1, wherein it is (G1, G2, G3) true for each micro-optical system (3) inside the same micro-optical system group (G1, G2, G3) that the optically active edge (320, 320*a*, 320*b*, 320*c*, 320*d*, 320*e*) of the micro-diaphragm (32) is displaced relatively to the micro-exit optical element (31) by a distance (h1, h2, h3, h4) vertically and/or horizontally and this distance (h1, h2, h3, h4) is the same for all micro-optical systems (3) inside the same micro-optical system group (G1, G2, G3), wherein the distance (h1, h2, h3, h4) is approximately 0 mm to approximately 0.1 mm.

3. The projection apparatus according to claim 2, wherein the distance (h1, h2, h3, h4) is approximately 0.01 mm to approximately 0.1 mm.

4. The projection apparatus according to claim 3, wherein the distance (h1, h2, h3, h4) is approximately 0.03 mm to approximately 0.06 mm.

5. The projection apparatus according claim 1, wherein the optically active edges (320, 320*a*, 320*b*, 320*c*, 320*d*, 320*e*) of at least a portion of the micro-optical systems (3) of each micro-optical system group (G1, G2, G3) are constructed for generating a continuously horizontal or vertical partial cut-off line or a partial cut-off line with an asymmetric rise, wherein each such optically active edge (320, 320*a*, 320*b*, 320*c*, 320*d*, 320*e*) is constructed for generating a continuously horizontal or vertical micro-cut-off line (3200) or a micro-cut-off line with an asymmetric rise (3201).

6. The projection apparatus according to claim 1, wherein each micro-diaphragm (32) is constructed as a small plate made from a non-transparent material with an opening (321, 321*a*, 321*b*, 321*c*, 321*d*, 321*e*).

7. The projection apparatus according to claim 1, wherein in different micro-optical system groups (G1, G2, G3), the micro-entrance optical elements (30) are positioned at the same height relative to the respective micro-exit optical elements (31) and have a common optical axis.

8. The projection apparatus according to claim 1, wherein the micro-optical systems (3) have an image scale of approximately 3° per 0.1 mm.

9. The projection apparatus according to claim 1, wherein the different micro-optical system groups (G1, G2, G3) are constructed separately from one another and are spaced from one another.

10. A light module (1) for a motor vehicle headlamp comprising:

the projection apparatus (2) according to claim 1; and a light source (7), wherein the projection apparatus (2) is downstream of the light source (7) in the light radiation direction and the light generated by the light source (7) is projected with a cut-off line (80) into a region in front of the light module in the form of a light distribution (8), wherein the light distribution is formed from a multiplicity of mutually overlapping partial light distributions with a partial cut-off line in each case, wherein each partial light distribution is formed by exactly one micro-optical system group and the partial cut-off lines together form the cut-off line (80).

11. The light module according to claim 10, wherein the partial cut-off lines are displaced by an angle with respect to one another along a vertical and/or horizontal, wherein the angle has a value of approximately 0° to approximately 3°.

12. The light module according to claim 11, wherein the angle has a value of approximately 2°.

13. The light module according to claim 10, wherein the partial cut-off lines run substantially in a straight line or have an asymmetric rise.

14. The light module according to claim 10, wherein the light source (7) is configured to generate collimated light.

15. The light module according to claim 10, wherein the light source (7) comprises a light-collimating optical element (9) and a semiconductor-based lamp element (10), which is upstream of the light-collimating optical element (9).

16. The light module according to claim 15, wherein the semiconductor-based lamp element (10) is an LED light source, and/or the light-collimating optical element (9) is a collimator, a light-collimating adapter optical element, or a TIR lens.

17. The light module according to claim 10, wherein the light source (7) has at least two light-emitting regions (70, 71, 72), wherein each individual light-emitting region can be controlled independently of the other light-emitting regions of the light source (7), and at least one micro-optical system group (G1, G2, G3), is assigned to each light-emitting region (70, 71, 72) in such a manner that light generated by the respective light-emitting region (70, 71, 72) impinges directly and only onto the micro-optical system group (G1, G2, G3) assigned to this light-emitting region (70, 71, 72).

18. A motor vehicle headlamp comprising at least one light module according to claim 10.

19. The projection apparatus according claim 1, wherein the differently running optical axes are displaced vertically and/or horizontally with respect to one another.

20. A light module (1) for a motor vehicle headlamp comprising:

a projection apparatus (2) for a light module (1) of a motor vehicle headlamp, the projection apparatus comprising:

a multiplicity of micro-optical systems (3) arranged in a matrix-like manner, wherein each micro-optical system (3) has a micro-entrance optical element (30), a micro-exit optical element (31) assigned to the micro-entrance optical element (30) and a micro-diaphragm (32), wherein all micro-entrance optical elements (30) form an entrance optical element (4), all micro-exit optical elements (31) form an exit optical element (5) and all micro-diaphragms (32) form a diaphragm device (6), wherein the diaphragm device (6) is arranged in a plane, which is orthogonal to a main radiation direction (Z) of the projection apparatus (2) in an intermediate image plane, and wherein the entrance optical element (4), the exit optical element (5) and the diaphragm device (6) are arranged in planes which are substantially parallel to one another, wherein the micro-diaphragm (32) of each micro-optical system (3) has an optically active edge (320, 320*a*, 320*b*, 320*c*, 320*d*, 320*e*), wherein the totality of the micro-optical systems (3) is divided into at least two micro-optical system groups (G1, G2, G3), wherein for the micro-optical systems (3) made from different micro-optical system groups (G1, G2, G3), the optically active edges (320, 320*a*, 320*b*, 320*c*, 320*d*, 320*e*) are positioned differently relative to the respective micro-exit optical elements (31) inside the intermediate image plane, and wherein the micro-diaphragms (32) of each micro-optical system group (G1, G2, G3) are combined to form a micro-diaphragm group (MG1, MG2) and the micro-diaphragm groups (MG1, MG2) are constructed identically, wherein the micro-diaphragm groups (MG1, MG2 are displaced in the vertical direction with respect to one another; and a light source (7), wherein the projection apparatus (2) is downstream of the light source (7) in the light radiation direction and the light generated by the light source (7) is projected with a cut-off line (80) into a region in front of the light module in the form of a light distribution (8), wherein the light distribution is formed from a multiplicity of mutually overlapping partial light distributions with a partial cut-off line in each case, wherein each partial light distribution is formed by exactly one micro-optical system group and the partial cut-off lines together form the cut-off line (80), and wherein the partial cut-off lines are displaced by an angle with respect to one another along a vertical and/or horizontal, wherein the angle has a value of approximately 0° to approximately 3°.

21. The light module according to claim 20, wherein the angle has a value of 1° to 3°.

* * * * *